US010571149B2

(12) United States Patent
Troxell et al.

(10) Patent No.: US 10,571,149 B2
(45) Date of Patent: Feb. 25, 2020

(54) MIXED AIR TEMPERATURE SENSOR BYPASS

(71) Applicant: Lennox Industries Inc., Richardson, TX (US)

(72) Inventors: Marcus Troxell, Frisco, TX (US); Michael Renker, McKinney, TX (US)

(73) Assignee: Lennox Industries Inc., Richardson, TX (US)

( * ) Notice: Subject to any disclaimer, the term of this patent is extended or adjusted under 35 U.S.C. 154(b) by 354 days.

(21) Appl. No.: 15/405,355

(22) Filed: Jan. 13, 2017

(65) Prior Publication Data

US 2017/0122612 A1 May 4, 2017

Related U.S. Application Data

(63) Continuation of application No. 14/219,306, filed on Mar. 19, 2014, now Pat. No. 9,581,350.

(60) Provisional application No. 61/897,068, filed on Oct. 29, 2013.

(51) Int. Cl.

| | |
|---|---|
| ***F24F 11/70*** | (2018.01) |
| ***F24F 11/30*** | (2018.01) |
| *F24F 11/00* | (2018.01) |
| *F24F 110/12* | (2018.01) |
| *F24F 110/10* | (2018.01) |

(52) U.S. Cl.

CPC ..... *F24F 11/70* (2018.01); *F24F 11/30* (2018.01); *F24F 2011/0006* (2013.01); *F24F 2110/10* (2018.01); *F24F 2110/12* (2018.01)

(58) Field of Classification Search

CPC ..... F24F 11/70; F24F 11/30; F24F 2110/12; F24F 2110/10; F24F 2011/0006

See application file for complete search history.

(56) References Cited

U.S. PATENT DOCUMENTS

| | | | | |
|---|---|---|---|---|
| 4,379,484 A * | 4/1983 | Lom | F25B 49/02 | 165/251 |
| 4,389,577 A * | 6/1983 | Anderson | G05D 23/1905 | 307/39 |
| 5,479,785 A * | 1/1996 | Novak | F25D 21/002 | 62/155 |
| 5,499,512 A * | 3/1996 | Jurewicz | G05D 23/1905 | 236/51 |
| 6,173,903 B1 * | 1/2001 | Loscher | G05B 9/03 | 219/508 |
| 6,223,544 B1 * | 5/2001 | Seem | F24F 11/30 | 62/127 |

(Continued)

*Primary Examiner* — Nelson J Nieves
(74) *Attorney, Agent, or Firm* — Winstead PC

(57) ABSTRACT

In an embodiment, a circuit for providing a mixed air temperature signal is provided. The circuit has a temperature input to an economizer controller, an air temperature sensor, a false air temperature device, and a switching device. The switching device has a switch and a switch actuating device. The switch connects the temperature input to the air temperature sensor when the switch is in a first state. The switch connects the temperature input to the false air temperature device when the switch is in a second state. The switch actuating device places the switch in the first state when a mechanical cooling signal is not sent. The switch actuating device places the switch in the second state when the mechanical cooling signal is sent.

14 Claims, 4 Drawing Sheets

(56) References Cited

U.S. PATENT DOCUMENTS

| | | | | |
|---|---|---|---|---|
| 6,296,193 | B1 * | 10/2001 | West | F24F 3/044 236/13 |
| 7,163,158 | B2 * | 1/2007 | Rossi | F24F 11/30 236/51 |
| 7,510,126 | B2 * | 3/2009 | Rossi | F24F 11/0009 236/51 |
| 7,778,737 | B2 * | 8/2010 | Rossi | H02J 3/14 700/276 |
| 2007/0251251 | A1 * | 11/2007 | Wojdyla | B60H 1/321 62/180 |
| 2008/0179409 | A1 * | 7/2008 | Seem | F24F 11/0001 236/49.3 |
| 2009/0236432 | A1 * | 9/2009 | Malloy | F24F 3/044 236/49.3 |
| 2010/0028501 | A1 * | 2/2010 | Baxter | A23G 9/28 426/231 |
| 2010/0125376 | A1 * | 5/2010 | Flohr | H02J 3/14 700/296 |
| 2011/0046790 | A1 * | 2/2011 | Miller | F24F 11/77 700/276 |
| 2011/0264275 | A1 * | 10/2011 | Thomle | F24F 12/006 700/276 |
| 2013/0013117 | A1 * | 1/2013 | Desrochers | F24F 7/08 700/276 |
| 2013/0219931 | A1 * | 8/2013 | Childs | F24F 11/83 62/115 |
| 2014/0207288 | A1 * | 7/2014 | Albrecht | F24F 11/0001 700/276 |
| 2014/0230543 | A1 * | 8/2014 | Fritz | G01K 3/005 73/295 |
| 2015/0132615 | A1 * | 5/2015 | Yun | H01M 10/486 429/50 |

* cited by examiner

MIXED AIR TEMPERATURE SENSOR BYPASS

CROSS-REFERENCE TO RELATED APPLICATIONS

This application is a continuation of U.S. patent application Ser. No. 14/219,306, filed on Mar. 19, 2014. U.S. patent application Ser. No. 14/219,306 claims priority from U.S. Provisional Patent Application No. 61/897,068 entitled MIXED AIR SENSOR BYPASS, filed on Oct. 29, 2013. U.S. patent application Ser. No. 14/219,306 and U.S. Provisional Patent Application No. 61/897,068 are incorporated herein by reference.

TECHNICAL FIELD

This application relates to HVAC controllers and, more particularly, to control of HVAC economizers.

BACKGROUND

A function of a Heating, Ventilation, and Air Conditioning (HVAC) unit is to cool an enclosed space, usually a building. A typical unit can perform two types of cooling, free cooling and mechanical cooling. In free cooling, the unit mixes cooler outdoor air with return air from the building. In mechanical cooling, mechanical components in the unit operate to condition air flowing through the unit. In particular, an evaporator coil absorbs heat from the air flowing past it.

Some units are controlled by an economizer controller, also called an economizer control system. During free cooling, the controller may control the unit based on mixed air, the mixture of outdoor air and return air received by the unit. The controller adjusts the relative amounts of outdoor air and return air, attempting to keep the temperature of the resulting mixed air at a mixed air set-point.

Technically, the term "mixed air" refers to air received by the unit that has not passed the evaporator coil. In contrast, the term "supply air" refers to the air after it passes the evaporator coil. Without mechanical cooling, mixed air temperature and supply air temperature are interchangeable. During mechanical cooling, the evaporator coil reduces the supply air temperature below the mixed air temperature.

In practice, due to space requirements, the temperature of the mixed air is often measured by a sensor located after the evaporator coil. In a typical HVAC unit, the outdoor air and the return air do not mix sufficiently until after the air passes the evaporator coil. If the mixed air temperature sensor were placed before the evaporator coil, either the outdoor air temperature or the return air temperature would dominate the temperature measured by the sensor. Therefore, to accurately measure the mixed air temperature, the mixed air temperature sensor is located after the evaporator coil.

Despite its name then, the "mixed air" temperature sensor really measures the temperature of supply air. The position of the mixed air temperature sensor creates an issue when free cooling and mechanical cooling are performed together. The evaporator coil tends to cool the air below the mixed air set-point. In response to the low mixed air temperature, the controller attempts to warm the mixed air. As a result, the controller signals the unit to stop using outdoor air to cool the building.

It would be desirable if a solution existed that would allow the unit to continue to receive outdoor air when free cooling is available and the unit is performing mechanical cooling.

It would further be desirable if the solution could be implemented with only minimal modifications to an existing HVAC unit and HVAC controller.

SUMMARY

In an embodiment, a circuit for providing a mixed air temperature signal is provided. The circuit has a temperature input to an economizer controller, an air temperature sensor, a false air temperature device, and a switching device. The switching device has a switch and a switch actuating device. The switch connects the temperature input to the air temperature sensor when the switch is in a first state. The switch connects the temperature input to the false air temperature device when the switch is in a second state. The switch actuating device places the switch in the first state when a mechanical cooling signal is not sent. The switch actuating device places the switch in the second state when the mechanical cooling signal is sent.

DESCRIPTION OF DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough explanation. However, such specific details are not essential. In other instances, well-known elements have been illustrated in schematic or block diagram form. Additionally, for the most part, specific details within the understanding of persons of ordinary skill in the relevant art have been omitted.

Figure 1:
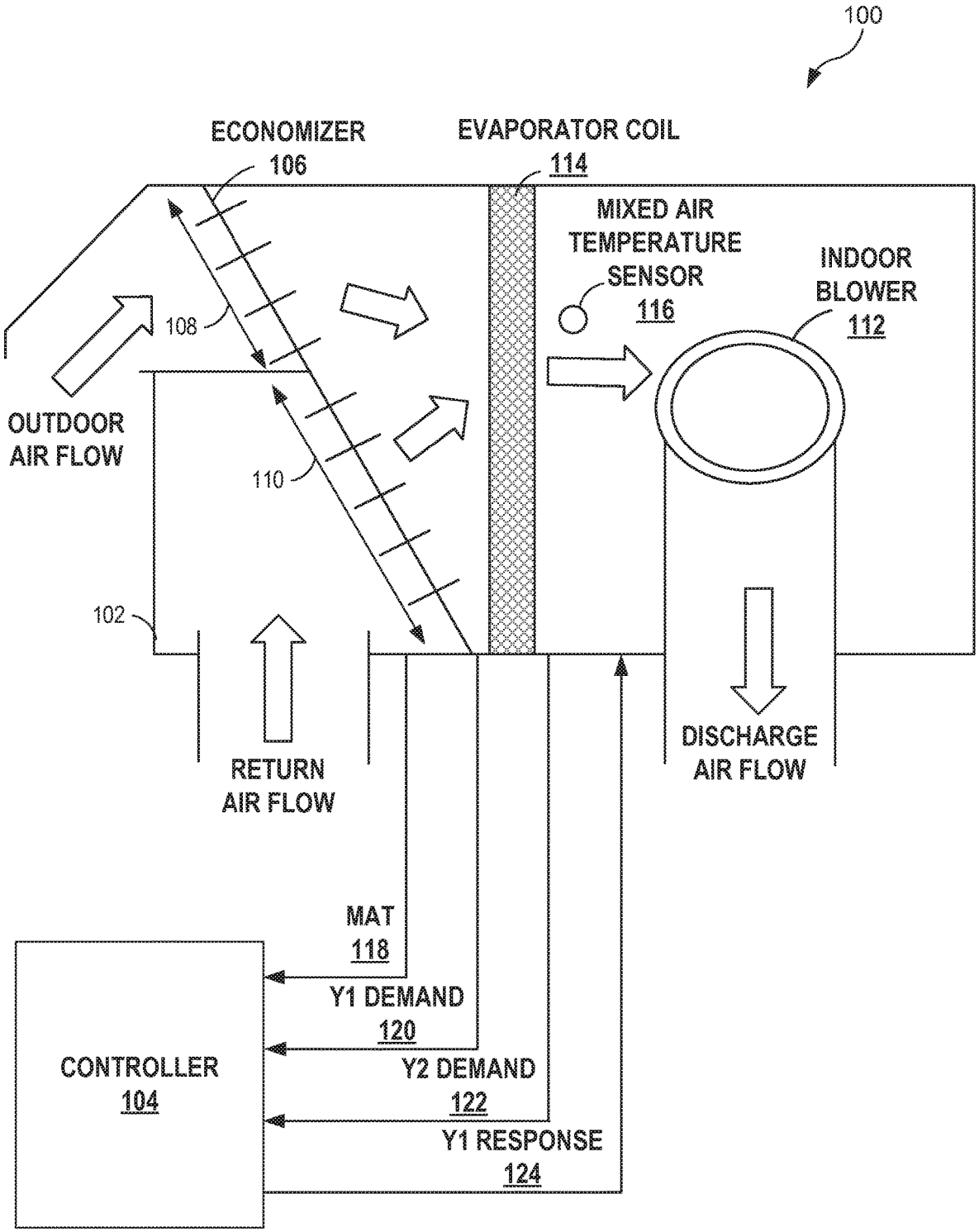
FIG. 1 PRIOR ART
FIG. 1 depicts a HVAC unit and a HVAC controller which may benefit from an exemplary embodiment of the present invention.

With reference to FIG. 1, depicted is a Heating, Ventilation, and Air Conditioning (HVAC) system 100 which may benefit from an exemplary embodiment of the present invention. HVAC system 100 comprises HVAC unit 102 and economizer controller 104. Generally speaking, unit 102 informs controller 104 of the cooling needs of the building, and controller 104 instructs unit 102 on how to respond to those cooling needs.

System 100 and unit 102 are described herein with the common term "HVAC," but only an air conditioning function of system 100 and unit 102 is discussed. It is not essential that system 100 or unit 102 be able to perform heating or ventilation. HVAC system 100 and HVAC unit 102 may have heating and ventilation functions, but those functions are optional.

Unit 102 contains mechanical components which, among other things, can draw air into unit 102, condition the air, and discharge the air into the building. Unit 102 also contains temperature sensors for air temperatures related to conditioning the air. Unit 102 may be referred to as a Roof-Top Unit (RTU). However, unit 102 is not necessarily located on a rooftop. Controller 104 may be referred to as an economizer controller or a unit controller.

Unit 102 has economizer 106. Economizer 106 comprises outdoor air damper 108 and return air damper 110. Outdoor air damper 108 can receive air from outside the building, and return air damper 110 can receive air returned from inside the building. Outdoor air damper 108 and return air damper 110 may each be opened, to receive air from their respective sources, or closed, to keep out air from their respective sources. The mix of air from outdoor air damper 108, if any, and return air damper 110, if any, is called the mixed air.

Unit 102 has blower 112. Blower 112 circulates air through unit 102, bringing in air from economizer 106 and discharging the air into the building.

Unit 102 has evaporator coil 114. During mechanical cooling, evaporator coil 114 absorbs heat from the air moving across it. Thus, the mixed air is considerably cooler after it moves past evaporator coil 114.

In free cooling, unit 102 obtains cool outdoor air from outdoor air damper 108 and uses that air to cool the building. Free cooling is preferable to mechanical cooling, because free cooling does not use energy to mechanically condition air. Free cooling uses energy to operate economizer 106 and blower 112, but the cooler air is obtained for free rather than being produced by unit 102. Free cooling therefore uses substantially less energy.

A purpose of controller 104 is to control free cooling. During free cooling, controller 104 attempts to keep the mixed air temperature at a mixed air set-point. The mixed air set-point may be set by a user, but is commonly 55 degrees Fahrenheit. Mixed air temperature sensor 116 senses the temperature of the mixed air. Controller 104 may read mixed air temperature sensor 116 from mixed air temperature (MAT) signal line 118.

To control the temperature of the mixed air, controller 104 adjusts economizer 106. When controller 104 determines the mixed air temperature is above the mixed air set-point, controller 104 instructs unit 102 to fully open outdoor air damper 108. When controller 104 determines the mixed air temperature is below the mixed air set-point, controller 104 instructs unit 102 to gradually close outdoor air damper 108 in an effort to raise the mixed air temperature.

Return air damper 110 may open and close inversely with outdoor air damper 108. As outdoor air damper 110 opens by an amount, return air damper 110 closes by the same amount. When outdoor air damper 108 closes by an amount, return air damper 110 opens by the same amount. When outdoor air damper 108 is fully open, return air damper 110 is fully closed, and vice versa.

Free cooling is only available when the outdoor air temperature, as measured by an outdoor air sensor on unit 102, is at or below an outdoor air set-point. When free cooling is unavailable, controller 104 instructs unit 102 to meet cooling demands through mechanical cooling. Unless otherwise specified, this discussion assumes free cooling is available.

In addition to MAT signal line 118, three other signal lines 120, 122, and 124 are shown between unit 102 and controller 104. Unit 102 and controller 104 will ordinarily have other signal lines in addition to those shown. The use of signal lines 118, 120, 122, and 124 will be illustrated with reference to FIG. 2. Unit 102 uses Y1 demand signal line 120 to inform controller 104 of an initial, or "stage 1," cooling demand. Unit 102 uses Y2 demand signal line 122 to inform controller 104 of an additional, or "stage 2," cooling demand. Controller 104 uses Y1 response signal line 124 to instruct controller 104 to begin mechanical cooling.

This discussion presents controller 104 as a controller which controls the mixed air temperature during free cooling. However, controller 104 reads the mixed air temperature from mixed air temperature sensor 116, and mixed air temperature sensor 116 really measures the temperature of supply air. Thus, controller 104 could also be called a controller which controls the supply air temperature during free cooling. Controller 104 could also be called a controller which does not distinguish between mixed air and supply air.

Figure 2:
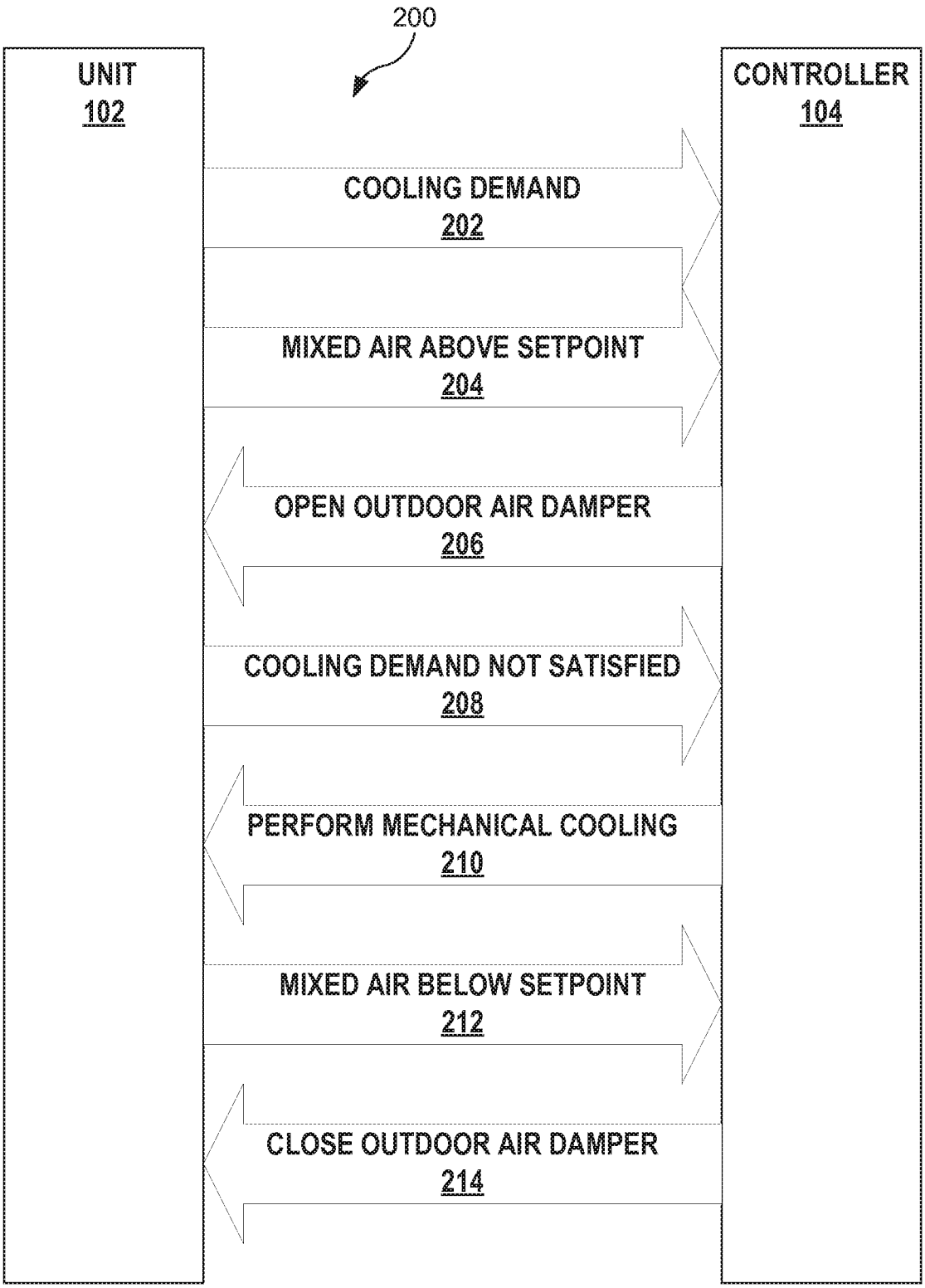
FIG. 2 PRIOR ART
FIG. 2 depicts communications between a HVAC control system and a HVAC unit in accordance with the prior art.

With reference to FIG. 2, depicted is an exemplary exchange 200 of signals between unit 102 and controller 104. In signal 202, unit 102 informs controller 104 that the building has a demand for cooling. Signal 202 may be referred to as a "Y1" signal, a "Y1 demand" signal, a "stage 1 demand" signal, or an "initial cooling demand" signal. Signal 202 may be sent over Y1 demand signal line 120. As an example, unit 102 may send signal 202 by sending 24V across the terminals of Y1 demand signal line 120 for the duration of the building's initial cooling demand.

In response to signal 202, controller 104 reads the mixed air temperature being provided from the mixed air temperature sensor in communication 202. Controller 104 may read the mixed air temperature from MAT signal line 118. When the mixed air temperature is above the mixed air set-point, controller 104 instructs unit 102 in signal 206 to fully open outdoor air damper 108. To save energy, controller 104 does not yet instruct unit 102 to begin mechanical cooling.

If the outdoor air received through outdoor air damper 108 is insufficient to cool the building, unit 102 informs controller 104 in signal 208 that the building's cooling demand has not been satisfied. Signal 208 may be referred to as a "Y2" signal, a "Y2 demand" signal, a "stage 2 demand" signal, or an "additional cooling demand" signal. Signal 208 may be sent over Y2 demand signal line 122. Similar to signal 202, unit 102 may send signal 208 by sending 24V across the terminals of Y2 demand signal line 122 for the duration of the additional cooling demand.

Controller 104 may then instruct unit 102 in signal 210 to begin mechanical cooling. Signal 210 may be referred to as a "Y1" signal, a "Y1 response" signal, a "Y1-O" signal, or a "mechanical cooling" signal. Signal 210 may be sent over Y1 response signal line 124. As an example, controller 104 may send signal 210 by sending 24V across the terminals of Y1 response signal line 124 for the time unit 102 is instructed to perform mechanical cooling.

When unit 102 begins mechanical cooling, an error occurs due to the position of mixed air temperature sensor 116 within unit 102. In unit 102, mixed air temperature sensor 116 is downstream of evaporator coil 114, as is typical in packaged rooftop HVAC units due to space requirements. Evaporator coil 114 absorbs heat, producing cool air which is ordinarily well below the mixed air set-point.

Mixed air temperature sensor 116 senses the temperature of this cool air. Unit 102 continues to monitor the mixed air temperature over MAT signal line 118. In signal 212, sent over MAT signal line 118, unit 102 informs controller 104 that the mixed air temperature is below the mixed air set-point. In signal 214, controller 104 responds by instructing unit 102 to close outdoor air damper 108. Because the mixed air temperature is likely to remain below the mixed air set-point, outdoor air damper 108 eventually fully closes.

Due to space requirements, mixed air temperature sensor 116 cannot be easily placed upstream of evaporator coil 114. However, closing outdoor air damper 108 is an inefficient result, because free cooling can reduce the amount of necessary mechanical cooling. It would be preferable to keep outdoor air damper 108 open when unit 102 is performing mechanical cooling while free cooling is available.

Figure 3:
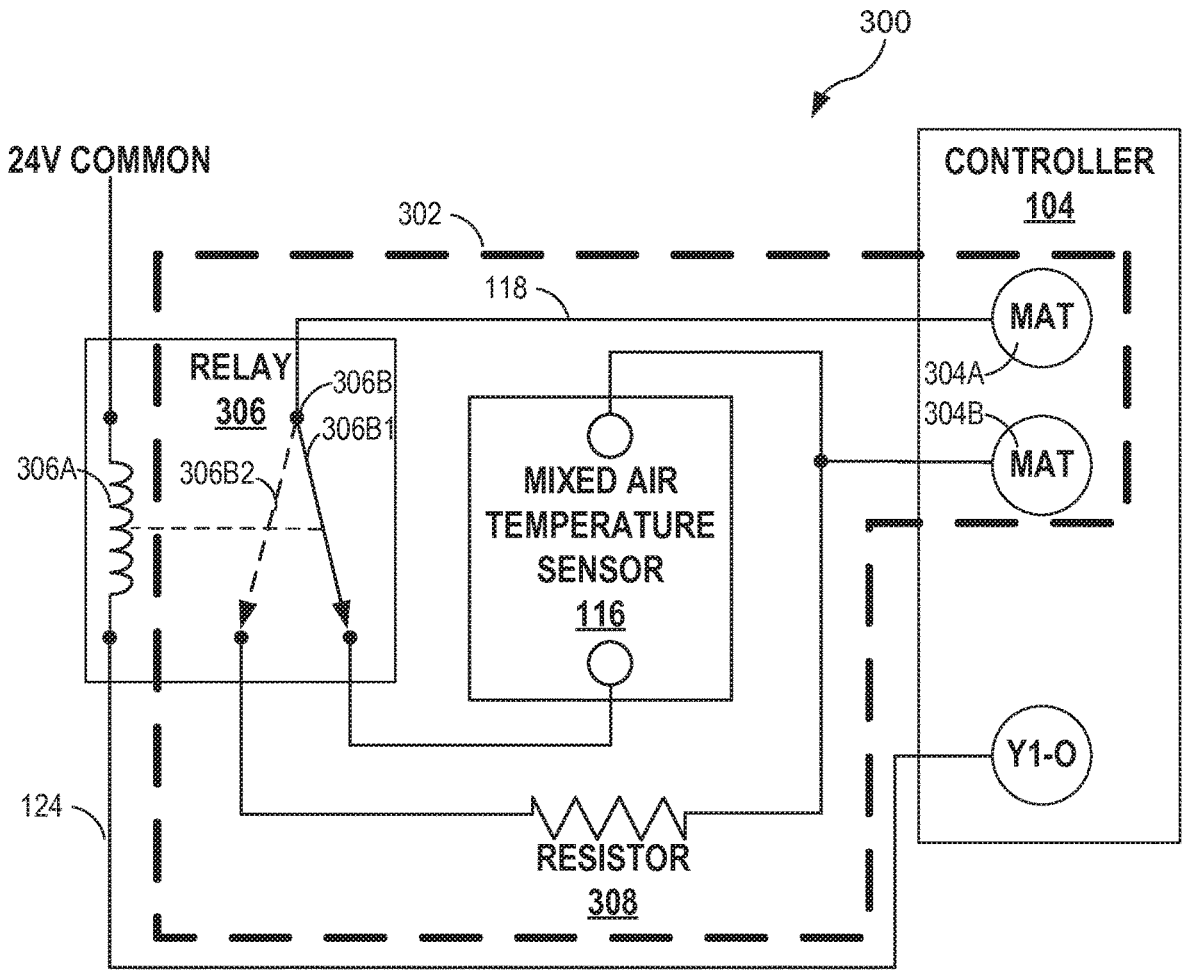
FIG. 3 is a wiring diagram in accordance with an exemplary embodiment of the present invention.

With reference to FIG. 3, depicted is a wiring diagram 300 showing a possible implementation of a solution. Controller 104, mixed air temperature sensor 116, MAT signal line 118, and Y1 response signal line 124 are shown. Circuit 302 is the circuit which controller 104 reads the mixed air temperature from. Controller 104 has MAT terminals 304A and 304B. MAT terminals 304A and 304B are the mixed air temperature input to controller 104. Controller 104 reads the voltage drop across terminals 304A and 304B as the mixed air temperature.

A relay 306 and a resistor 308 have been introduced. Relay 306 has an inductor 306A and a switch 306B. Inductor 306A is placed on Y1 response signal line 124. When controller 104 sends signal 210 on Y1 response signal line 124, signal 210 energizes relay 306.

Switch 306B controls the temperature input received by controller 104 on MAT signal line 118. When relay 306 is not energized, switch 306B is in position 306B1. Controller 104 receives a temperature from mixed air temperature sensor 116 as is conventional. Mixed air temperature sensor 116 creates a voltage drop across terminals 304A and 304B. The voltage drop represents the mixed air temperature.

When relay 306 is energized, switch 306B is in position 306B2. In position 306B2, relay 306 replaces the input of mixed air temperature sensor 116 to controller 104 with resistor 308. Resistor 308 produces a voltage drop across terminals 304A and 304B. The voltage drop mimics a mixed air temperature at or above the mixed air set-point. Thus, while relay 306 is energized, controller 104 receives a false mixed air temperature from resistor 308, rather than the actual mixed air temperature from mixed air temperature sensor 116. In an embodiment, the mimicked mixed air temperature is 70 degrees Fahrenheit, but any mixed air temperature at or above the mixed air set-point is sufficient.

The circuit in wiring diagram 300 may be easily implemented in an existing unit 102 and controller 104. One need only insert relay 306 in lines 124 and 118, and add resistor 308 to circuit 302. The existence of relay 306 and resistor 308 is transparent to unit 102 and controller 104.

Figure 4:
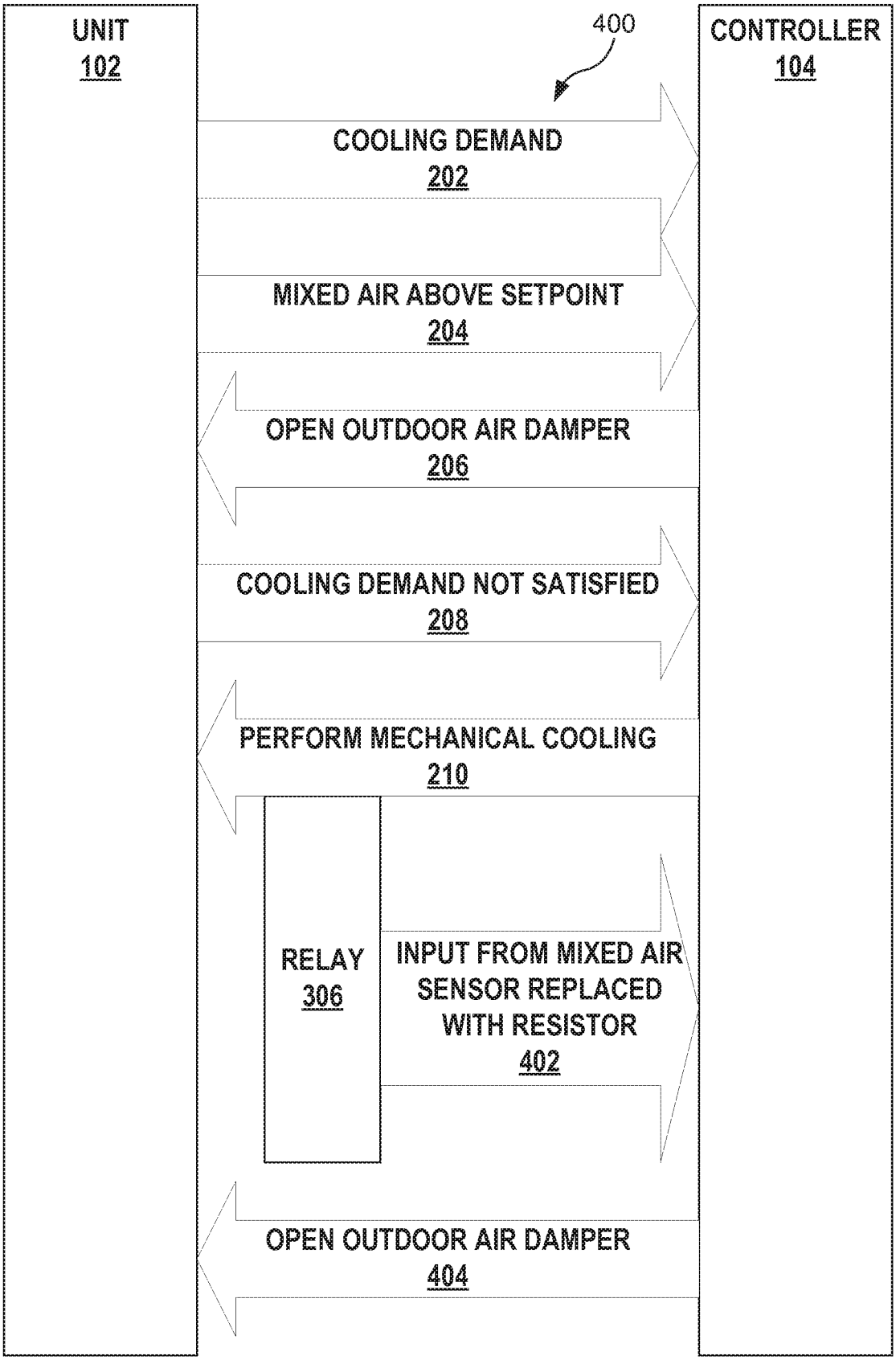
FIG. 4 depicts communications between a HVAC control system and a HVAC unit in accordance with an exemplary embodiment of the present invention.

With reference to FIG. 4, depicted is an exchange 400 of signals between unit 102 and controller 104 in accordance with wiring diagram 300. Also participating in exchange 400 is relay 306.

Exchange 400 is identical to exchange 200 in FIG. 2 until controller 104 sends signal 210 to unit 102, instructing unit 102 to perform mechanical cooling. On its way to unit 102, signal 210 energizes relay 306. While relay 306 intercepts unit signal 210, signal 210 continues to unit 102 and causes unit 102 to begin mechanical cooling.

Because relay 306 is energized, switch 306B moves from position 306B 1 to position 306B2. Controller 104 receives signal 402, the false mixed air temperature from resistor 308. Signal 402 indicates to controller 104 that the mixed air temperature is above the mixed air set-point. In response, controller 104 sends signal 404, instructing unit 102 to fully open outdoor air damper 108.

Some controllers do not account for mechanical cooling when controlling free cooling. In other words, these controllers control free cooling identically whether or not the unit is also performing mechanical cooling. Relay 306 and resistor 308 are most useful for these controllers. The false mixed air temperature from resistor 308 modifies the behaviour of a controller without any modification to the controller itself.

Other controllers can account for mechanical cooling when controlling free cooling. Relay 306 and resistor 308 can also be used with these controllers. The controllers receive the false mixed air temperature, and the controllers can also adjust their behaviour according to the mechanical cooling.

It is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of various embodiments.

The invention claimed is:

1. A method for providing a mixed air temperature signal, the method comprising:

receiving a mechanical cooling signal; and in response to the mechanical cooling signal:

disconnecting a temperature input from an air temperature sensor, the temperature input comprising an input to an economizer controller; and connecting the temperature input to a false air temperature device;

wherein the mechanical cooling signal is sent from the economizer controller to a unit, the unit comprising an air conditioning function; and wherein receiving the mechanical cooling signal comprises an inductor intercepting the mechanical cooling signal.

2. The method of claim 1, further comprising:

receiving an end to the mechanical cooling signal; and in response to end to the mechanical cooling signal:

disconnecting the temperature input from the false air temperature device; and connecting the temperature input to the air temperature sensor.

3. The method of claim 1, wherein:

the temperature input comprises a mixed air temperature input; and the air temperature sensor comprises a mixed air temperature sensor.

4. The method of claim 1, wherein the false air temperature device comprises a resistor.

5. The method of claim 1, wherein:

the economizer controller controls an economizer of the unit;

the unit comprises the economizer, an evaporator coil, and the air temperature sensor; and the evaporator coil is between the air temperature sensor and the economizer.

6. The method of claim 4, wherein:

the temperature input comprises a first terminal and a second terminal;

when connected to the temperature input, the air temperature sensor produces a voltage drop across the temperature input; and when connected to the temperature input, the resistor produces a voltage drop across the temperature input.

7. The method of claim 6, wherein:

the economizer controller comprises a mixed air set-point; and the voltage drop produced by the resistor represents a temperature greater than or equal to the mixed air set-point.

8. A method for providing a mixed air temperature signal, the method comprising:

receiving a mechanical cooling signal; and in response to the mechanical cooling signal:

disconnecting a temperature input from an air temperature sensor, the temperature input comprising an input to an economizer controller; and connecting the temperature input to a false air temperature device;

the economizer controller controls an economizer of a unit, the unit comprising the economizer, an evaporator coil, and the air temperature sensor;

the evaporator coil is between the air temperature sensor and the economizer; and wherein receiving the mechanical cooling signal comprises an inductor intercepting the mechanical cooling signal.

9. The method of claim 8, further comprising:

receiving an end to the mechanical cooling signal; and in response to end to the mechanical cooling signal:

disconnecting the temperature input from the false air temperature device; and connecting the temperature input to the air temperature sensor.

10. The method of claim 8, wherein:

the temperature input comprises a mixed air temperature input; and the air temperature sensor comprises a mixed air temperature sensor.

11. The method of claim 8, wherein the mechanical cooling signal is sent from the economizer controller to the unit, the unit comprising an air conditioning function.

12. A method for providing a mixed air temperature signal, the method comprising:

receiving a mechanical cooling signal; and in response to the mechanical cooling signal:

disconnecting a temperature input from an air temperature sensor, the temperature input comprising an input to an economizer controller, wherein the economizer controller comprises a mixed air set-point; and connecting the temperature input to a false air temperature device, wherein the false air temperature device comprises a resistor;

the temperature input comprises a first terminal and a second terminal;

when connected to the temperature input, the air temperature sensor produces a voltage drop across the temperature input; and when connected to the temperature input, the resistor produces a voltage drop across the temperature input, the voltage drop represents a temperature greater than or equal to the mixed air set-point.

13. The method of claim 12, wherein the mechanical cooling signal is sent from the economizer controller to a unit, the unit comprising an air conditioning function.

14. The method of claim 13, wherein receiving the mechanical cooling signal comprises an inductor intercepting the mechanical cooling signal.

* * * * *